US007255756B2

(12) United States Patent
Tsao et al.

(10) Patent No.: US 7,255,756 B2
(45) Date of Patent: Aug. 14, 2007

(54) ALUMINUM ALLOY WITH IMPROVED MECHANICAL PROPERTIES AT HIGH TEMPERATURES

(75) Inventors: Chi-Yuan Tsao, Tainan (TW); Yen-Hao Su, Taichung Hsien (TW); Chun-Hsien Chiang, Tainen Hsien (TW)

(73) Assignee: National Cheng Kung University, Tainan (TW)

( * ) Notice: Subject to any disclaimer, the term of this patent is extended or adjusted under 35 U.S.C. 154(b) by 0 days.

(21) Appl. No.: 11/189,441

(22) Filed: Jul. 25, 2005

(65) Prior Publication Data

US 2006/0081311 A1 Apr. 20, 2006

(30) Foreign Application Priority Data

Oct. 14, 2004 (TW) ..... 93131151 A

(51) Int. Cl.
*C22C 21/02* (2006.01)

(52) U.S. Cl. ..... 148/415; 420/541; 420/546; 420/548

(58) Field of Classification Search ..... 148/415; 420/541, 548, 546
See application file for complete search history.

(56) References Cited

U.S. PATENT DOCUMENTS 5,614,036 A 3/1997 Imahashi et al.

FOREIGN PATENT DOCUMENTS

JP 56163234 A * 12/1981
JP 63028841 A * 2/1988

* cited by examiner

*Primary Examiner*—Roy King
*Assistant Examiner*—Janelle Morillo
(74) *Attorney, Agent, or Firm*—Darby & Darby

(57) ABSTRACT

Disclosed herein is an aluminum alloy composition consisting essentially of, on the basis of total weight of the composition, 13 to 28 wt % of silicon, 1.5 to 5 wt % of a metal element selected from iron and manganese, 3 to 10 wt % of zinc, 0.5 to 1 wt % of magnesium, and aluminum as balance. Also disclosed herein is an aluminum alloy product made from said aluminum alloy composition and exhibiting improved mechanical properties at high temperatures, including excellent wear resistance, hardness and thermal stability.

2 Claims, 4 Drawing Sheets

ALUMINUM ALLOY WITH IMPROVED MECHANICAL PROPERTIES AT HIGH TEMPERATURES

CROSS-REFERENCE TO RELATED APPLICATIONS

This application claims priority of Taiwanese application No. 093131151, filed on Oct. 14, 2004.

BACKGROUND OF THE INVENTION

1. Field of the Invention

This invention relates to aluminum alloy compositions consisting essentially of, on the basis of total weight of the composition, 13 to 28 wt % of silicon, 1.5 to 5 wt % of a metal element selected from iron and manganese, 3 to 10 wt % of zinc, 0.5 to 1 wt % of magnesium, and aluminum as balance.

This invention also relates to aluminum alloy products made from said aluminum alloy compositions, the aluminum alloy products exhibiting improved mechanical properties at high temperatures, including excellent wear resistance, hardness and thermal stability.

2. Description of the Related Art

Aluminum alloys have been widely used in the automobile, transportation and other industries due to their high strength-to-weight ratio, superior processing properties and excellent weather-resistance. In early years, aluminum alloys were employed in the industry primarily due to the lightweight characteristics thereof, and the wear resistance of the same was seldom considered. However, since the 1970s, there arose many problems that need to be solved. In the first aspect, due to energy crisis, it was highly desired in industry to manufacture lightweight transportation vehicles that work with high efficiency. In the second aspect, since excellent wear-resistance was an indispensable property for some key components of transportation vehicles, manufacturers in the industry therefore endeavored to develop aluminum alloys with high wear-resistance.

Heretofore, precipitation hardening treatment is the main process used in the art to strengthen the hardness of commercially available aluminum alloys with median or high strength, such as aluminum alloys 2024, 6063, 7075, JIS AC9A, AA A390, etc. Precipitation hardening treatment is primarily conducted as follows: A selected aluminum alloy is heated to a specific temperature lower than the melting point thereof for a period of time, causing the added elements contained in the aluminum alloy to solubilize within the α-Al phase of the aluminum alloy. The above-described operating procedure is called "solid solution treatment." Once the added elements are completely solubilized within the α-Al phase of the aluminum alloy, the aluminum alloy is immediately immersed into a low temperature medium, so that a super-saturation of the solubilized elements within the aluminum alloy is achieved instead of the formation of precipitated particles from the solubilized elements. The thus-obtained aluminum alloy containing therein a super-saturation of solubilized elements is then placed at a specific temperature to cause particle precipitation from the super-saturated elements within the aluminum alloy. The above-described operating procedure is called "aging treatment."

The commercially available wear-resistant aluminum alloys, such as JIS AC9A, AA A390, etc., must be subjected to the precipitation hardening treatment in order to obtain a sufficient mechanical strength. However, the precipitation hardening treatment is time-consuming and costly. In addition, if these aluminum alloys are combined with other series of aluminum alloys by "casting in", their heat treatment conditions will be strictly limited and they may even become unsuitable for heat treatment. With respect to aluminum alloys 2024, 6063 and 7075, if they are held at a temperature higher than 150° C., the precipitates contained in strengthening phase thereof, such as $MgZn_2$ and $Al_2Cu$, will immediately become coarsened, thus deteriorating the strengthening effect of such aluminum alloys. Therefore, aluminum alloys 2024, 6063 and 7075 are only available for use at a temperature below 150° C.

However, with the advancement in the transportation industry, and in view of the increasing need of developing lightweight vehicles, applications of aluminum alloys have been extended to include environments with high temperatures. For example, they may be used to form engine blocks, engine cylinder liners, compressor pistons, disc brakes, etc. Therefore, it has become a very important subject in the light-metal industry to develop aluminum alloys with excellent mechanical properties at high temperatures.

In view of the aforesaid, it is highly desired to develop aluminum alloys that can be formed without precipitation hardening treatment and that exhibit improved mechanical properties at high temperatures, including excellent wear resistance, hardness and thermal stability.

SUMMARY OF THE INVENTION

Therefore, according to a first aspect, this invention provides an aluminum alloy composition consisting essentially of, on the basis of total weight of the composition, 13 to 28 wt % of silicon, 1.5 to 5 wt % of a metal element selected from iron and manganese, 3 to 10 wt % of zinc, 0.5 to 1 wt % of magnesium, and aluminum as balance.

According to a second aspect, this invention provides an aluminum alloy product made of the aforesaid aluminum alloy composition. The aluminum alloy product has been proven to exhibit improved mechanical properties at high temperatures, including excellent wear resistance, hardness and thermal stability.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE INVENTION

Figure 1:
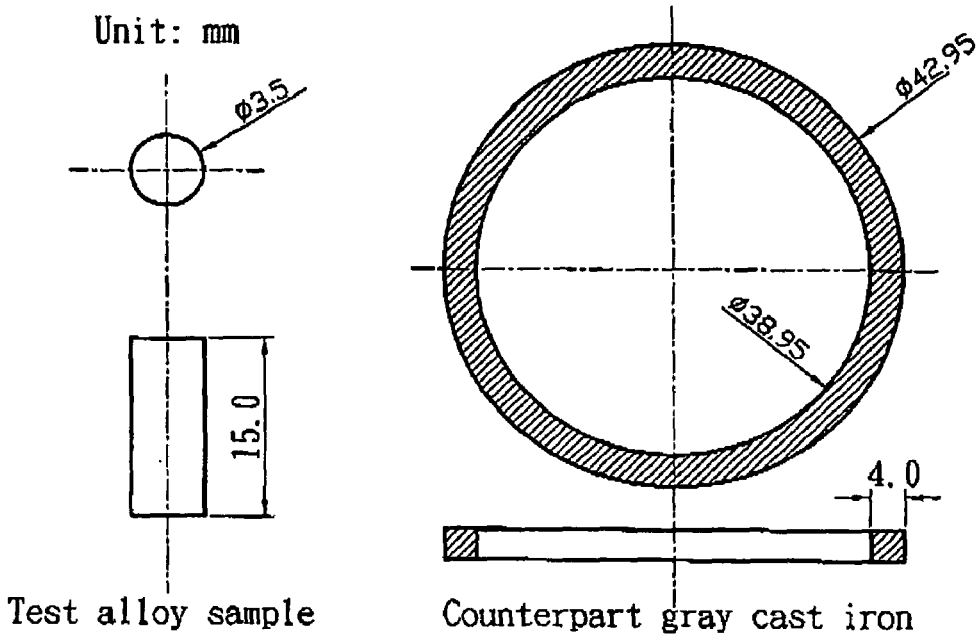
FIG. 1 shows the dimensions of a test alloy sample and a disc-shaped counterpart (gray cast iron) for use in a wear test.

Presently, aluminum alloys with excellent mechanical properties at elevated temperatures higher than 100° C., or even reaching 150° C. to 250° C., are highly desired by manufacturers in different industries. In order to achieve this goal, the applicants provided herein an aluminum alloy composition consisting essentially of, on the basis of total weight of the composition, 13 to 28 wt % of silicon, 1.5 to 5 wt % of a metal element selected from iron and manganese, 3 to 10 wt % of zinc, 0.5 to 1 wt % of magnesium, and aluminum as balance.

In a preferred embodiment of this invention, the aluminum alloy composition consists essentially of, on the basis of the total weight of the composition, 18 to 28 wt % of silicon, 2.5 to 5 wt % of the metal element selected from iron and manganese, 5 to 10 wt % of zinc, 0.5 to 1% magnesium, and aluminum as balance.

In a more preferred embodiment of this invention, the aluminum alloy composition consists essentially of, on the basis of the total weight of the composition, 25 wt % of silicon, 2.5 wt % of iron, 10 wt % of zinc, 1 wt % of magnesium, and aluminum as balance.

In another more preferred embodiment of this invention, the aluminum alloy composition consists essentially of, on the basis of the total weight of the composition, 25 wt % of silicon, 2.5 wt % of manganese, 10 wt % of zinc, 1 wt % of magnesium, and aluminum as balance.

In aluminum alloys, aluminum (Al) acts as an alloy base to support other alloying elements that are selected for addition into the alloy base so as to create an aluminum alloy having specific properties as desired.

Silicon (Si) is a material of high-hardness and, hence, is known to have a superior wear-resistance property. The addition of silicon to an aluminum alloy can significantly improve the wear-resistance property of said aluminum alloy. In addition, a high silicon-content aluminum alloy will have a lower thermal expansion coefficient, a high thermal conductivity, and a high strength-to-weight ratio. Therefore, the inclusion of silicon in the compositions of aluminum alloys useful for the manufacture of engines can give rise to many beneficial outcomes. For example, engines made from such aluminum alloys are more efficient in operation and are resources-saving and friendly to the environment.

With respect to Zinc (Zn), when it is included in the composition of an aluminum alloy, a part of Zn may be solubilized within the aluminum alloy and another part of Zn may be included within a precipitated phase due to its reaction with Al. However, the main function of zinc element is to act as a solid solution-strengthening element In aluminum alloys.

Iron (Fe) can improve the mechanical properties of aluminum alloys in terms of thermal stability, tensile strength, hardness and elongation. In iron-containing aluminum alloys, a small amount of Fe element may form β-AlFeSi intermetallic compounds that influence the plastic deformation of the aluminum alloys to a certain degree.

Concerning magnesium (Mg), when it is included in the composition of an aluminum alloy, a very small part of Mg will be solubilized within the aluminum alloy and almost all part of Mg reacts with Si to form $Mg_2Si$ compounds, which distribute the strengthening effect throughout the aluminum alloy. Therefore, the hardness of the aluminum alloy is improved.

The aforesaid aluminum alloy composition may be formed into an aluminum alloy product. Therefore, in a second aspect, this invention provides an aluminum alloy product made from the aluminum alloy composition as described above.

According to this Invention, the aluminum alloy product may be formed by various solidification processes commonly used in the art for the manufacture of alloys, including, but not limited to, spray forming process, gravity casting, die casting, permanent mold casting, and squeeze casting.

As used herein, the term "α-Al phase" refers to the base phase of the aluminum alloy. In the α-Al phase of an aluminum alloy, there may be distributed numerous particles formed during the solidification process, or precipitated particles that are formed as a result of the variation of the solid solubility of α-Al. All of these particles, which may have influence upon the mechanical properties of the aluminum alloy, including strength, thermal stability, wear-resistance, etc., are referred to as the "second phase."

In a preferred embodiment of this invention, the aluminum alloy product is formed by spray forming an aluminum alloy composition as described above. The thus-obtained aluminum alloy product may have a microstructure composed of a continuous α-Al phase, and a finely distributed second phase including round silicon particles with a diameter smaller than 5 μm, and rod-shaped β-AlFeSi Intermetallic compounds having a longitudinal axis shorter than 3 μm. The second phase may also Include other intermetallic compounds in trace amounts, such as $Mg_2Si$ and α-AlSiFe.

In another preferred embodiment of this invention, the aluminum alloy product is formed by gravity casting an aluminum alloy composition as described above. The thus-obtained aluminum alloy product may have a microstructure composed of a continuous α-Al phase, and a discontinuous second phase including multi-faceted silicon particles having a diameter ranging from tens to hundreds μm, and rod-shaped β-AlFeSi intermetallic compounds having a longitudinal axis ranging from 20 to 50 μm. The second phase may also include other intermetallic compounds in trace amounts, such as $Mg_2Si$ and α-AlSiFe.

The aluminum alloy product of this invention has been found to exhibit excellent mechanical properties at high temperatures, including wear resistance, hardness and thermal stability.

In a preferred embodiment of the Invention, the aluminum alloy product of this invention is thermally stable and exhibits excellent wear-resistance at temperatures ranging up to 250° C.

In a more preferred embodiment of the invention, the aluminum alloy product of this invention is thermally stable and exhibits excellent wear-resistance at a temperature ranging from 100° C. to 200° C.

In a most preferred embodiment of the invention, the aluminum alloy product of this invention is thermally stable and exhibits excellent wear-resistance at a temperature ranging from 100° C. to 150° C.

In a wear test simulating the operating conditions of an engine cylinder liner, an aluminum alloy of this Invention was proven to exhibit superior wear-resistance than gray cast iron, a conventionally used liner material. In addition, as compared to a wear-resistant aluminum alloy JIS AC9A, an aluminum alloy of this invention was proven to exhibit a room temperature hardness (expressed as Brinell hardness (HBN), $Kg/mm^2$) reaching HBN 97 after being held at 150° C. for five days.

If needed, the aluminum alloy product of this invention may be further subjected to a post-processing treatment commonly used in the art for the manufacture of alloys, so as to provide a final product with desired properties. Suitable post-processing treatment for the aluminum alloy product of this invention includes, but is not limited to, heating treatment, extrusion, deformation and machining.

In view of the unique properties of the aluminum alloy product of this invention. It is contemplated that the aluminum alloy product of this invention may have a variety of industrial applications, e.g., parts of transportation vehicles that require excellent wear-resistance, hardness and thermal stability properties when operated at temperatures over 100° C., such as engine blocks, engine cylinder liners, compressor pistons, disc brakes, wheel rims for airplanes, etc.

This invention will be further described by way of the following examples. One of ordinary skill in the art is familiar with many techniques and teachings allowing the modification of these examples and the examples noted throughout this disclosure that would also employ the basic, novel, or advantageous characteristics of the Invention. Thus, the scope of this invention is not limited by the particular examples listed here or elsewhere.

EXAMPLES

In the following experiments, gray cast iron, a traditional aluminum alloy AA6061, and a wear-resistant aluminum alloy JIS AC9A were used for comparison with an aluminum alloy of this invention, in which:

1. gray cast iron, which is a commercially available material commonly used in the manufacture of engine piston rings, has the chemical composition of: C, 2.75-4%; Si, 0.75-3%; Mn, 0.25-1.5%; S, 0.02-0.2%; and P, 0.02-0.75%;
2. AA6061, which is an alloy product based on the standards of American Society for Metals, has the chemical composition of: Si, 0.4-0.8%; Fe, 0.7%; Cu, 0.15-0.4%; Mn, 0.15%; Mg, 0.8-1.2%; Cr, 0.04-0.35%; Zn, 0.25%; and Ti, 0.15%; and
3. JIS AC9A, which is an alloy product based on the standards of Japanese Standards Association, has the chemical composition of: Si, 22-24%; Cu, 0.5-1.5%; Mg, 0.5-1.5%; Ni, 0.5-1.5%; Zn<0.2%; Fe<0.8%; Mn<0.5%; and Ti<0.2%.

In the following experiments, the practice of this invention will be described in detail with reference to an aluminum alloy formed by spray forming an aluminum alloy composition that consists essentially of, on the basis of the total weight of the composition, 25 wt % of silicon, 2.5 wt % of iron, 10 wt % of zinc, 1 wt % of magnesium, and aluminum as balance.

The wear-resistance property of a test alloy sample was tested using a pin-on disc model, in which a test alloy and a counterpart (gray cast iron) for use in a wear test were shaped to have the dimensions as shown in FIG. 1. Specifically, the test alloy sample was shaped into a cylinder (3 mm in diameter and 15 mm in length) with one end being round-shaped for contact with the upper surface of a disc-shaped counterpart (gray cast iron) during the wear test. The disc-shaped counterpart (gray cast iron) had an outer diameter of 42.95 mm and an inner diameter of 38.95 mm, so that the test alloy sample can slide along the upper surface thereof during the wear test.

Figure 2:
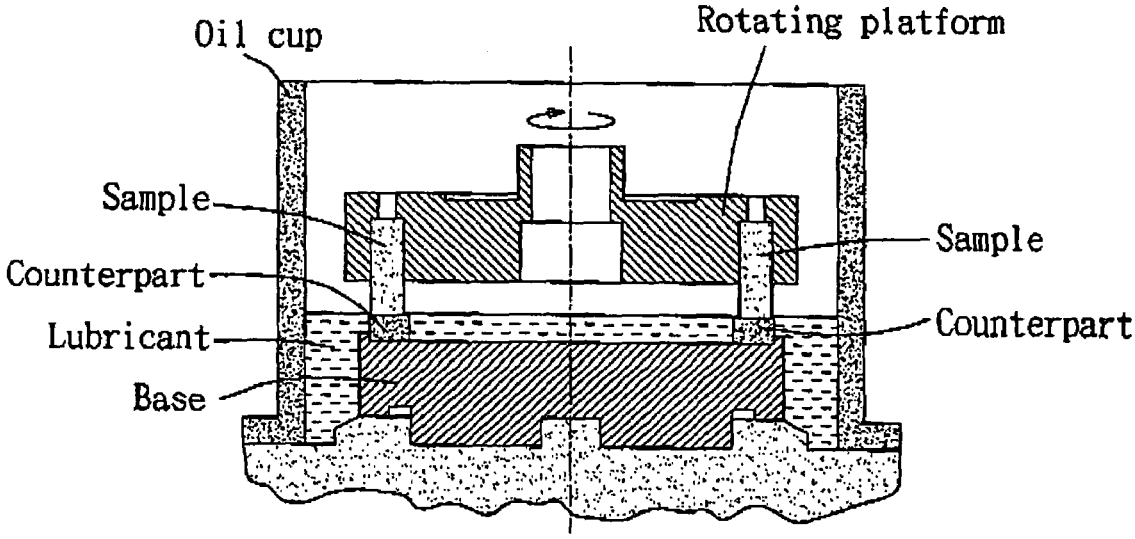
FIG. 2 is a schematic view showing the layout of an equipment to test the wear resistance of a test alloy sample.

The wear test was conducted using the equipment as shown in FIG. 2. After the disc-shaped counterpart (gray cast iron) and two test alloy samples were placed in position, a lubricant (SAE 20W50 oil) was added to a depth as shown in FIG. 2, which allowed the interface between the disc-shaped counterpart (gray cast iron) and each of the two test alloy samples to be immersed within the lubricant. The equipment was set to run at a speed of 0.61 $ms^{-1}$ under a pressure of 5.0 Mpa. The wear test was then conducted under lubricant condition at room temperature and engine service temperature (125° C.).

Figure 3:
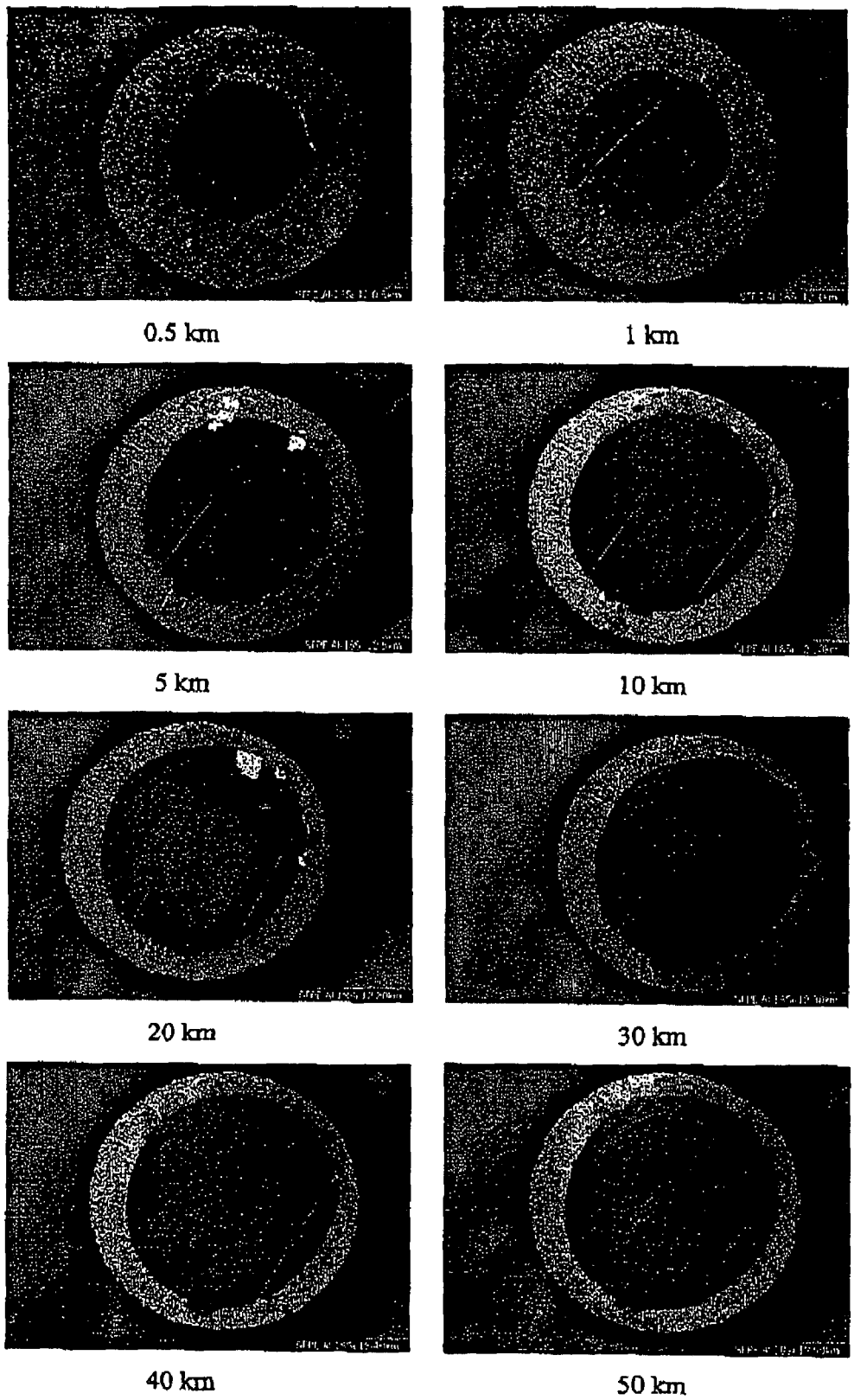
FIG. 3 shows worn area morphologies of a test alloy sample against a disc-shaped counterpart (gray cast iron) that were varied with sliding distances as tested by the equipment of FIG. 2.

It can be seen from FIG. 3 that the worn area of a test alloy sample against the disc-shaped counterpart (gray cast iron) varied with the sliding distance thereof along the disc-shaped counterpart (gray cast iron).

Figure 4:
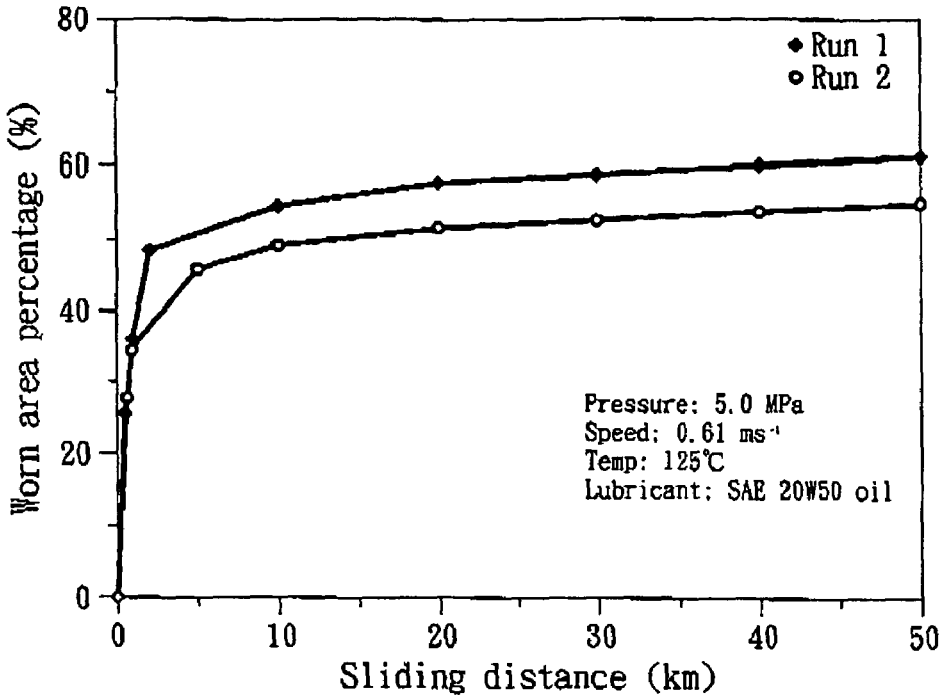
FIG. 4 is a graph plotting the worn area percentages (%) vs. sliding distances (km) of a test alloy sample against a disc-shaped counterpart (gray cast iron) as tested by the equipment of FIG. 2, the experiment being conducted in duplicate.

FIG. 4 is a graph plotting the worn area percentages (%) vs. sliding distances (km) of a test alloy sample against the disc-shaped counterpart (gray cast Iron) as tested by the equipment of FIG. 2. It can be seen from FIG. 4 that the increase in the worn area percentage of the test alloy sample gradually reached a stationary phase when the sliding distance of the test alloy sample exceeded 20 km. To validate the results of the following experiments, the sliding distance of a test alloy sample was set to 50 km.

Figure 5:
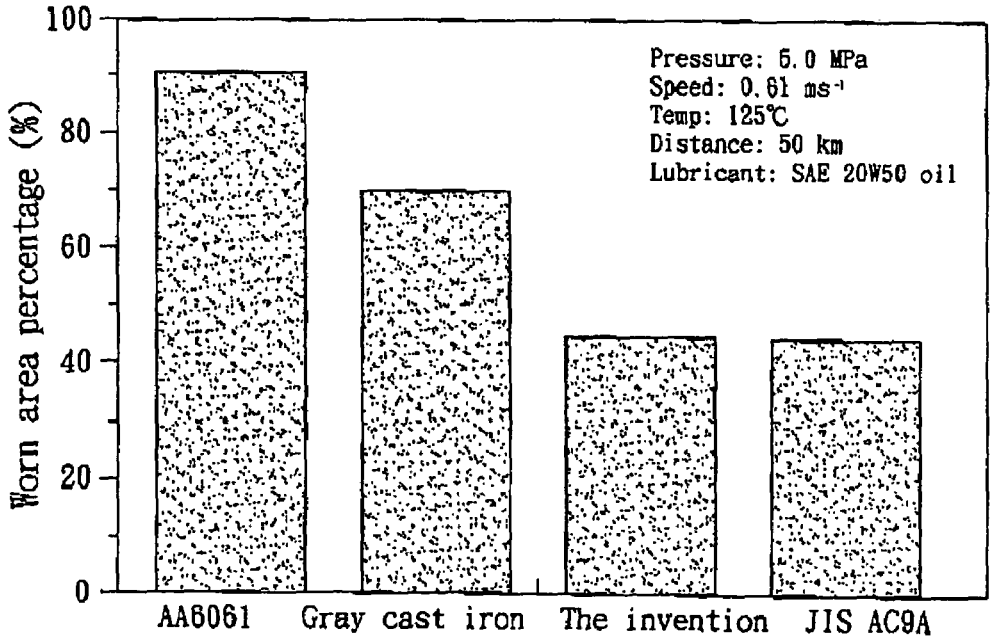
FIG. 5 shows the wear-resistance results of an aluminum alloy of this invention, a traditional aluminum alloy AA6061, a wear-resistant aluminum alloy JIS AC9A, and gray cast iron.

An aluminum alloy of this invention, gray cast iron, a traditional aluminum alloy AA6061, and a wear-resistant aluminum alloy JIS AC9A were subjected to the wear test as described above. The obtained wear-resistance results are shown in FIG. 5, in which the aluminum alloy of this invention is significantly superior to gray cast iron and the traditional aluminum alloy AA6061, and is comparable to JIS AC9A.

A thermal stability test was conducted to compare the thermal stability of an aluminum alloy of this invention and a wear-resistant aluminum alloy JIS AC9A (which was not subjected to a precipitation hardening treatment) after being held at 150° C. for a predetermined period of time. Specifically, the test alloy samples were held at 150° C. for the indicated time periods, followed by cooling to room temperature. Thereafter, the room temperature hardness of each of the test alloy samples was detected by a Brinell hardness test. The obtained results are shown in FIG. 6.

Figure 6:
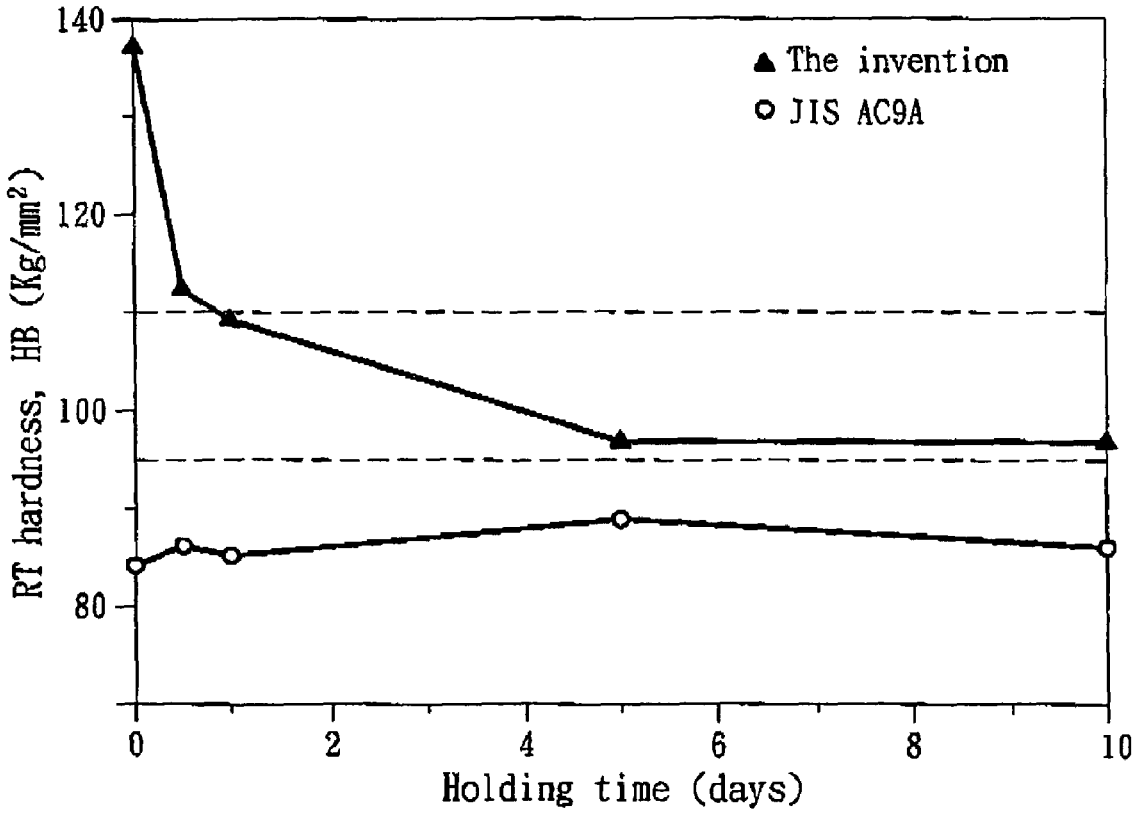
FIG. 6 compares the thermal stability of an aluminum alloy of this invention and a wear-resistant aluminum alloy JIS AC9A after being held at 150° C. for a period of time, in which the abscissa represents the period of time (day) of the tested aluminum alloys held at 150° C., and the ordinate represents the room temperature hardness of the tested aluminum alloys after a predetermined period of 150° C. heat treatment (expressed as Brinell hardness (HBN), $Kg/mm^2$).

It can be seen from FIG. 6 that the hardness of the aluminum alloy of this invention reached a stable Brinell hardness value of 97 after being held at 150° C. for five days. The aluminum alloy of this invention is significantly superior to JIS AC9A in terms of thermal stability and hardness.

In conclusion, the aluminum alloy of this invention has a specific chemical composition so that it exhibits improved mechanical properties at high temperatures, including excellent wear resistance, hardness and thermal stability. In addition, the aluminum alloy of this invention can be economically produced since i does not have to be subjected to a precipitation hardening treatment so as to obtain a sufficient mechanical strength.

While the invention has been described with reference to the above specific embodiments, it is apparent that numerous modifications and variations can be made without departing from the scope and spirit of this invention. It is therefore intended that this Invention be limited only as indicated by the appended claims.

We claim:

1. An aluminum alloy composition consisting essentially of, on the basis of the total weight of the composition: 25 wt % of silicon, 2.5 wt % of iron, 10 wt % of zinc, 1 wt % of magnesium, and aluminum as balance.

2. An aluminum alloy composition consisting essentially of, on the basis of the total weight of the composition: 25 wt % of silicon, 2.5 wt % of manganese, 10 wt % of zinc, 1 wt % of magnesium, and aluminum as balance.

* * * * *